United States Patent [19]

Kotitschke et al.

[11] Patent Number: 4,698,918

[45] Date of Patent: Oct. 13, 1987

[54] DEVICE FOR TRANSFERRING A PAPER WEB FROM THE PRESS SECTION TO THE DRYING SECTION OF A PAPER MACHINE

[75] Inventors: Gerhard Kotitschke, Steinheim; Hans-Werner Höricke, Deggendorf, both of Fed. Rep. of Germany

[73] Assignee: J. M. Voith GmbH, Heidenheim, Fed. Rep. of Germany

[21] Appl. No.: 14,988

[22] Filed: Feb. 17, 1987

Related U.S. Application Data

[60] Division of Ser. No. 912,134, Sep. 23, 1986, Pat. No. 4,677,763, which is a continuation of Ser. No. 676,789, Nov. 30, 1984, abandoned.

[30] Foreign Application Priority Data

Dec. 7, 1983 [DE] Fed. Rep. of Germany ..... 3344217

[51] Int. Cl.[4] ..... F26B 13/68

[52] U.S. Cl. ..... 34/116; 34/117; 34/123

[58] Field of Search ..... 34/116, 117, 120, 123; 162/193, 225, 289, 206, 207

[56] References Cited

U.S. PATENT DOCUMENTS

| | | | |
|---|---|---|---|
| 1,734,879 | 11/1927 | Read | 162/193 |
| 1,789,515 | 1/1931 | Cram et al. | 162/193 |
| 4,359,827 | 11/1982 | Thomas | 34/114 |
| 4,543,160 | 9/1985 | Kerttula et al. . | |

*Primary Examiner*—Larry I. Schwartz

*Attorney, Agent, or Firm*—Jeffers Hoffman & Niewyk

[57] ABSTRACT

A backing screen runs together with the paper web through the drying section of a paper machine. The backing screen bridges the space between the press section and the drying section. For threading the so-called transfer strip through the drying section there is a rope carrier provided whose ropes run outside the paper web width. Prior to its insertion at the entrance point of the rope carrier, the transfer strip, which is separated from the backing screen, is passed across a mechanical guide element which, sideways and from the outside, can be moved into the area of the backing screen and back again. The mechanical guide element is movable so that the space between the guide element and the backing screen is variable.

6 Claims, 5 Drawing Figures

Fig. 4
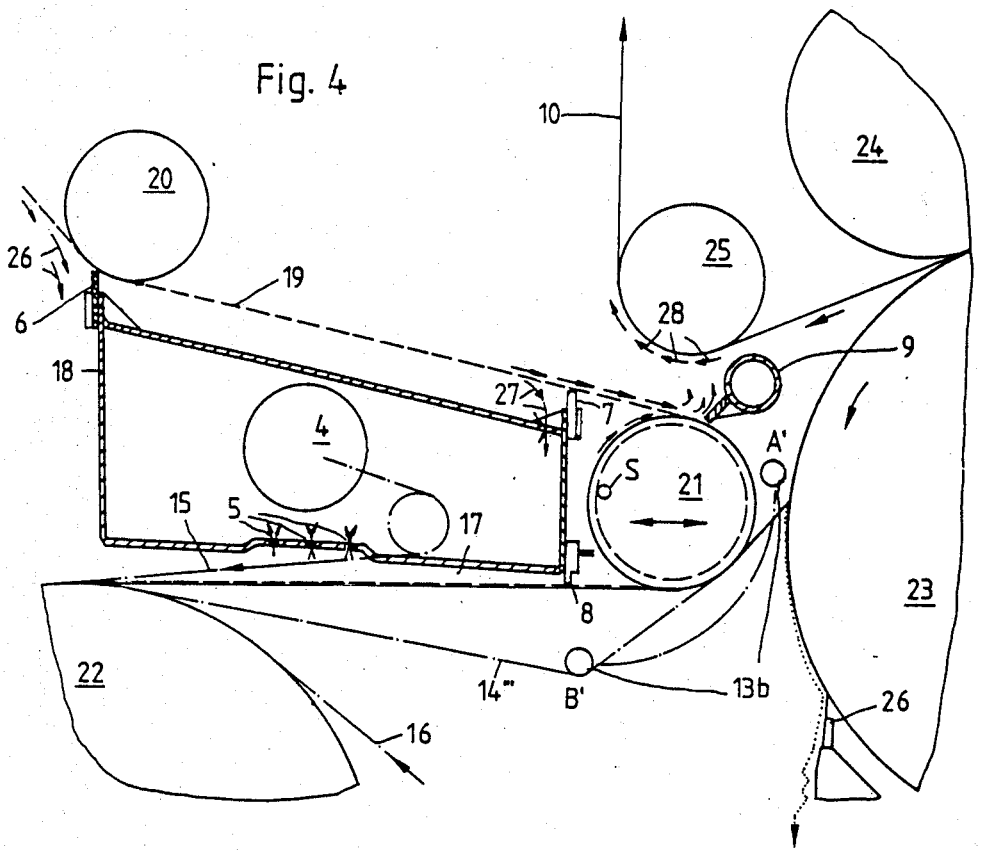
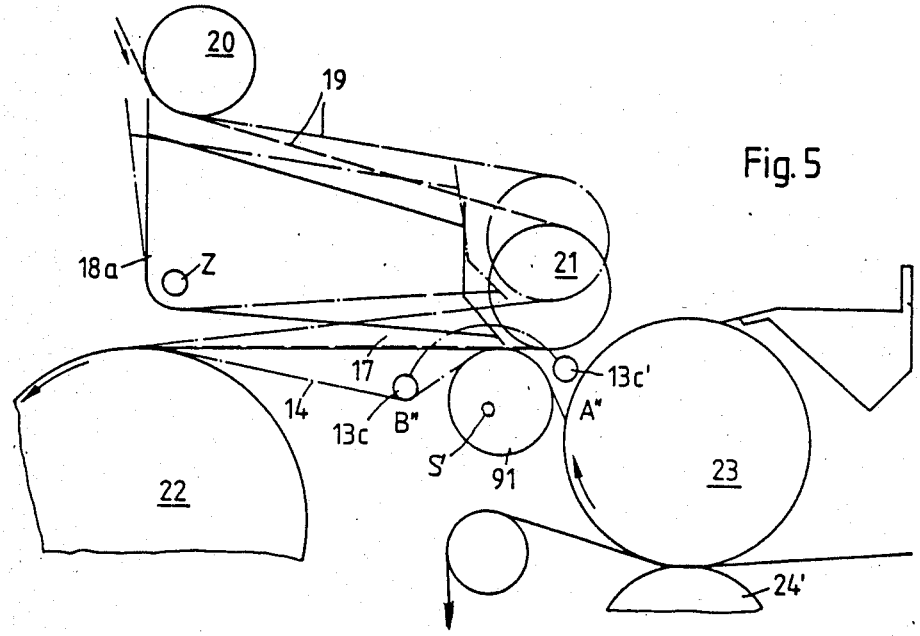
Fig. 5

DEVICE FOR TRANSFERRING A PAPER WEB FROM THE PRESS SECTION TO THE DRYING SECTION OF A PAPER MACHINE

This is a division of application Ser. No. 912,134 filed Sept. 23, 1986, now U.S. Pat. No. 4,677,763 which is a continuation of Ser. No. 676,789 filed Nov. 30, 1984, abandoned.

BACKGROUND OF THE INVENTION

The invention concerns a device for transferring a paper web from the press section to the drying section of a paper machine.

Most modern paper machines use rope carriers for "threading" the paper web into the drying section in restarting the paper machine such as after a standstill or web break. These rope carriers are designed as set out below. In each drying cylinder group, two ropes run along the path of the paper web. To begin the threading operation, one introduces a narrow edge strip of the paper web, the so-called transfer strip, into the rope carriers in the drying cylinder group. During this threading phase, the remaining part of the paper web is passed from the screen or from one of the press rolls to a scrap collection container. Next, the transfer strip is widened until it reaches the full width of the web so that, lastly, the entire paper web is passing through the drying section.

As commonly known, the rope carrier is located on the tending aisle edge of the drying cylinders, and at that, outside the paper web width. Therefore, the transfer strip must be diverted sideways from its normal path, before the point of entering the rope carrier.

A prior rope carrier of that type is described in German Patent Publication No. 25 38 846(1). There, the paper web proceeds from a granite roll, which together with another press roll forms the last press gap, freely to a first guide roll and thence, as well freely, to a second guide roll. There, the entrance point of the rope carrier is arranged. In the presence of such open paper trains, the sideways diversion of the transfer strip can be accomplished with relative ease, routing it to the entrance point of the rope carrier. But a disadvantage of this arrangement is the danger of longitudinally stretching the still moist paper web in the unsupported trains.

Therefore, roll configurations have recently been given preference which provide an uninterrupted web guidance from the press section to the drying section. Some examples are shown in the following documents: U.S. Pat. No. 3,874,997; German Disclosure No. 27 30 149 (U.S. Pat. No. 4,183,248); U.S. Pat. Nos. 4,359,827; and 4,359,828.

In all of these prior paper machines, a backing belt of machine width runs over a guide roll arranged in the press section and then to the drying section so as to run over at least its first drying cylinder. Thus, the backing belt carries the paper web from the press section to the drying section in a fashion so as to support it on its way from the press section to the drying sections and so as to not subject it to any appreciable longitudinal stretching.

But difficulties are encountered when such prior paper machines are to be equipped with a rope carrier. (The cited publications do not describe rope carriers or similar devices for threading the paper web into the drying section.) The reason for these difficulties is that with a continuous paper support from the press section to the drying section, the transfer strip will cling to the backing so as to resist sideways deflection or permit sideways deflection only with great difficulty while being guided to the entrance point of the rope carrier.

Therefore, it has also been suggested previously to arrange on a paper machine with continuous paper transfer the entrance point of the rope carrier so as not to be on the first, but be on the second drying cylinder. This type of arrangement has been suggested since the transfer strip leader separates from the backing without any particular measures after passing the first drying cylinder. This occurrence facilitates diverting the transfer strip to the entrance point of the rope carrier. However, in such an arrangement, it may prove to be a hindrance that the entrance point of the rope carrier is then located within the steam cover of the drying section.

As can be appreciated, there has existed a problem in designing a paper machine with continuous paper transfer from the press section to the drying section, and which features a rope carrier, that the threading of the transfer strip to the entrance point of the rope carrier can be accomplished easily and without risk. It would thus be desirable to provide a paper machine with continuous paper transfer from the press section to the drying section, and which features a rope carrier, wherein the threading of the transfer strip to the entrance point of the rope carrier can be accomplished easily and without risk.

SUMMARY OF THE INVENTION

This problem is solved by applicants' invention. By applicants' invention there is provided a carrier means for temporarily carrying the transfer strip separated from the backing belt. The transfer means is positioned adjacent the transfer strip between the guide roll and the first drying cylinder. The carrier means provides for measures through which the transfer strip, despite the paper transfer which is continuous in normal operation, runs in the area between the press section and the first drying cylinder temporarily at such a great distance from the backing that it is possible to manually divert the transfer strip sideways and pass it to the entrance point of the rope carrier arranged on the first drying cylinder. One advantage with applicants' invention is that this action occurs at an easily accessible point, namely, between the press section and the first drying cylinder.

Another advantage with applicants' invention is that the first drying cylinder requires no separately controlled drive for threading the paper web into the drying section.

BRIEF DESCRIPTION OF THE DRAWINGS

The above-mentioned and other features and objects of this invention and the manner of attaining them will become more apparent and the invention itself will be best understood by reference to the following description of embodiments of the invention taken in conjunction with the accompanying drawings.

FIG. 4 shows a modification of the arrangement illustrated in FIG. 1; and FIG. 5 shows a section of a paper machine similar to FIG. 4, but for a different press section design.

DETAILED DESCRIPTION OF SPECIFIC EMBODIMENTS

Figure 1:
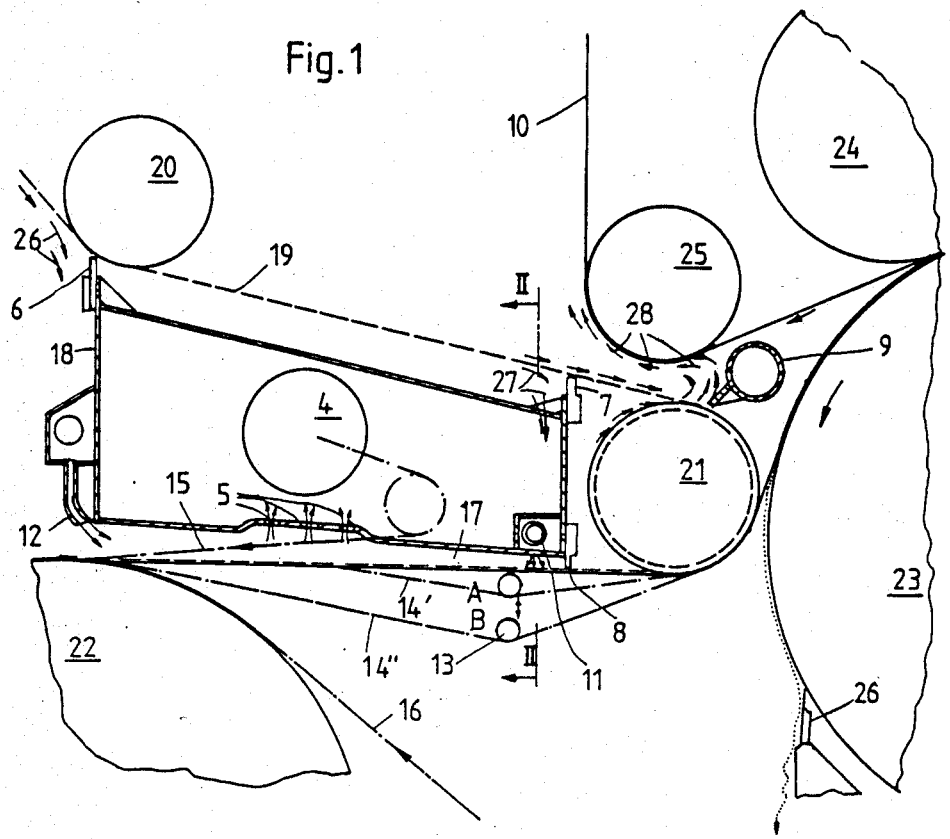
FIG. 1 shows a paper machine section, and at that, the point of transfer from the press section to the drying section, partly as a schematic view and partly in section.

Referring to FIG. 1, the press section includes a granite roll 23 and a press roll 24 forming between them the last press gap of the press section. The wet felt 10 passes through the press gap and over to the felt guide roll 25.

The drying section includes the first drying cylinder 22 an two guide rolls 20 and 21 on which runs a continuous backing. Preferably, the backing is fashioned as a backing screen permeable to air. The guide roll 21 is a slotted roll (or a suction roll) and is arranged directly beside the granite roll 23 so that the backing screen 19 during the normal operating condition of the paper machine will receive the paper web directly from the granite roll 23 and carry it to the drying section. The paper guide roll 21 is so arranged that, at the most, a small space exists between the cylinder faces of granite roll 23 and paper guide roll 21.

On the backing screen 19 side which is not in contact with the paper web, i.e., inside the backing screen loop, a so-called foil box 18 is arranged between the guide roll 21 and the drying cylinder 22. During the normal operation of the paper machine, the purpose of the foil box 18 is to hold the paper web on the backing screen 19 while on its way from the guide roll 21 to the drying cylinder 22. The gap 17 between the box underside and the backing screen has for that purpose a customary wedge-shaped design. A suction line 4 may additionally be connected to the foil box for exhausting air from the gap 17 through suction openings 5. Deflectors 6, 7 and 8 attached to the foil box as well as a blade 9 and the wet felt 10 direct the air transported by the backing screen into areas where air flows are harmless (see arrows 26, 27, 28). The blade 9 extends through the space between rolls 21, 23 and 25.

Figure 2:
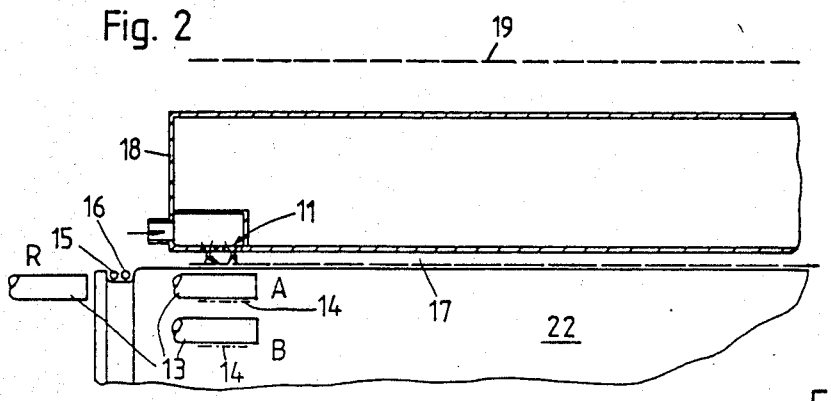
FIG. 2 shows a section along line II—II of FIG. 1.

Illustrated in FIG. 1 are the paths of the two ropes 15 and 16 of the rope carrier serving to thread the transfer strip through the drying section. FIG. 2 shows the ropes 15 and 16 in schematic cross section running in a rope groove in the outer end of the drying cylinder.

For inserting the transfer strip at the entrance point of the rope carrier, the suction line 4 in the foil box is shut off. The entire paper web, including the transfer strip, runs at first along the dotted line as illustrated in FIG. 1, over the granite roll 23 to the scraper 26 which passes it downward into a not illustrated scrap collection container.

An elongate guide element or rod 13 is positioned outside the paper machine during the normal operation of the paper machine. This so called normal operating position of rod 13 is illustrated as position R in FIG. 2. Rod 13 is movable to another position which it is closely underneath the backing screen 19 in the area of the normal path of the transfer strip 14. This position of rod 13 is illustrated as position A in FIG. 2.

Now, with rod 13 in position A, the transfer strip can be blown as usual from the granite roll 23 onto the cylinder 22. The transfer strip proceeds along line 14' between the backing screen 19 and the drying cylinder 22 and is lifted off the cylinder, behind the point where the backing screen 19 separates from the cylinder 22, with the aid of a not illustrated scraper.

Next, the rod 13 is moved from position A to position B which is illustrated in FIG. 1. Additionally, a slight speed differential is set between the granite roll 23 and the cylinder 22 thereby causing the transfer strip to run across the rod 13 in a stretched and taut fashion along line 14''. The transfer strip can now be diverted manually and passed into the "rope scissors", that is, the entrance point of the rope carrier (contact points of the ropes 15 and 16 on the cylinder 22). It is advantageous to position rod 13 in position B, a position in which the rod 13 is spaced farther from the backing screen 19, so as to optimally lower the accident hazard associated with guiding the transfer strip into the rope scissors.

Lastly, the rod 13 is first moved back from position B into position A, and then back from position A into the normal operating or inoperative position R thereby allowing the transfer strip 14 to make contact with the backing screen 19. The rod 13 is suitably left for a short period in position A, thus permitting the transfer strip to gradually position itself on the backing screen 19, that is, without any risk of wrinkling. Eventually, the transfer strip runs, on its normal path and within the paper web width, through the entire drying section. Now, as the case may be, the suction in the foil box is turned on and the cut-off squirt (which separates the transfer strip from the paper web) is moved to the full width.

In addition, or as an alternative to the rod 13, the transfer strip can be lifted off the backing screen 19 by blowing air through it with the aid of nozzles 11 and 12, causing the transfer strip to proceed, similar to the description above, approximately along line 14'' to the drying cylinder 22 where it can be diverted manually to the entrance point of the rope carrier.

The joint installation of both transfer devices, i.e., both the rod 13 (or a guide roll) and the air nozzles 11 and/or 12, is called for when there is a risk that the transfer strip might break as it passes through the drying section. In this case, the transfer strip must be diverted again into the rope scissors. But for that purpose it is not necessary to repeat the entire process described above from the very start. Instead, the transfer strip 14 proceeding on the backing screen 19 from the guide roll 21 to the cylinder 22 is separated from the backing screen with the aid of blowing air until it follows approximately the path 14' or 14''. If it is required, the rod 13 may also be moved in position A and then to position B as is described above.

According to FIGS. 1 and 2, the rod 13 has a cylindrical shape. Rod 13 is positioned so as to be generally parallel with the axes of rotation of the guide roll 21 and the cylinder 22. When in positions A and B rod 13 extends only slightly beyond the width of the transfer strip 14 toward the other side of the paper machine.

Figure 3:
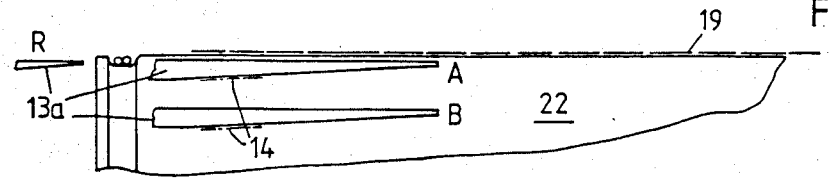
FIG. 3 shows another embodiment in a section the same as in FIG. 2.

FIG. 3 shows another possible design of the rod **13*a*. Rod 13*a* tapers toward the other end of the paper machine. In addition, rod 13*a* is considerably longer than the rod 13 (illustrated in FIG. 2), i.e., it extends beyond the width of the transfer strip 14 toward the other side of the paper machine. When retracting the rod 13 from the position A into position R with the embodiment according to FIG. 2 there is still a risk of a wrinkle forming in the transfer strip. The surface of rod 13*a* facing the transfer strip tapers towards the other end of the paper machine. In view of this taper, the cut-off squirt may be moved to full width when the rod 13*a* is still in position A, or at least while the rod 13*a*** is being reset from position A to position R so as to provide for a more stable run of the transfer strip through the drying section.

The arrangement presented in FIG. 4 differs from that according to FIG. 1, to begin with, by a greater spacing between the guide roll 21 and the granite roll 23. This makes it possible to introduce a rod **13*b* into the space between these two rolls, and at that, where the circumference of the guide roll 21 is no longer in contact with the paper web (position A'). From this position, the rod 13***b* can be swiveled down about its axis S to eventually assume its position B'. See FIG. 4. The swivel axis S is eccentric to the axis of rotation of the guide roll 21 in such a way that the spacing of the rod 13*b* from the guide roll 21 becomes greater on its way into position B' from position A'.

The advantage of this design is that the rod 13*b* is completely outside the path of the paper web, namely, in position A', as the point of the transfer strip 14 is being carried from the granite roll 23 to the drying cylinder 22. Thus, the transfer strip cannot strike the rod 13*b* or tangle with it. The transfer strip 14 proceeds first along the normal path of the paper web, from the granite roll 23 via the backing screen 19 to the cylinder 22. As the rod 13*b* is now moved from position A' to position B', it lifts the transfer strip off the backing screen 19 and carries it temporarily along path 14'''. The transfer strip can now be diverted manually, as already described above, and introduced in the rope scissors. Next, the rod 13*b* is slowly swiveled back again into position A', causing the transfer strip 14 to make contact again with the backing screen 19. Now the paper web may be brought to its full width.

With this method it is safe to say that the air nozzles 11 and 12 relative to FIGS. 1 and 2 are not required, for which reason they were omitted in the embodiment illustrated in FIG. 4.

If during the normal paper machine operation it is desired to set a smaller spacing between guide roll 21 and granite roll 23, the guide roll 21 is suitably made adjustable. For example, in FIG. 4, the guide roll 21 is illustrated as being adjustable in the horizontal direction.

With the arrangements according to FIGS. 1 and 4, the press gap is located between the granite roll 23 and the press roll 24 in the upper area of the cylinder of the granite roll 23. Hence the paper web runs downwardly to the guide roll 21. FIG. 5 shows a different arrangement. The press roll 24' is now arranged underneath the granite roll 23 and the paper web runs upwardly to the backing screen guide roll 21. Required below the latter is now an additional paper guide roll 91 which carries the paper web from the granite roll 23 onto the backing screen 19 proceeding to the cylinder 22. The normal position of guide roll 21 and foil box 18*a* is illustrated by solid lines in FIG. 5. A common swivel axis Z is provided for the foil box 18*a* and the guide roll 21, near the drying cylinder 22, making it possible to swivel these two components upward into the position indicated by dashed lines for carrying out the transfer process.

A carrier rod 13*c* may be introduced in the space between the rolls 21, 23 and 91 (position A''). With the foil box 18*a* and the guide roll 21 swiveled up, the rod 13*c'* may be swiveled in position B'' about the circumference of the paper guide roll 21. The swivel axis S' is preferably eccentric to the axis of rotation of the paper guide roll 21 in a way such that the distance between the rod 13*c'* and the paper guide roll 91 becomes greater through said swivel movement.

The air nozzles 11 and 12 present in FIGS. 1 and 2 are not required for the design according to FIG. 5. But the suction zone formed by the wedge-shaped gap 17 is suitably extended toward the guide roll as far as possible. This will facilitate the transfer of the paper web from the paper guide roll 91 to the backing screen 19. This applies especially to the moment of carrying the point of the transfer strip across at the beginning of the transfer process. As the case may be, a small suction box may be provided on the foil box 18*a* in the area of the transfer strip above the paper guide roll 91. The rope carrier, with the design according to FIG. 5, is arranged in the same way as in FIGS. 1 and 4. In FIG. 5, the ropes 16 and 17 have been omitted.

The procedure for introducing the transfer strip in the rope scissors is as follows:

1. Carrying the tip of the transfer strip across from the granite roll 23 to the paper guide roll 91 whereafter the transfer strip proceeds on the backing screen 19 to the cylinder 22.
2. Moving the rod 13*c* in position A''.
3. Raising the foil box 18*a* along with the guide roll 21.
4. Swiveling the rod 13*c* from position A'' to position B''.
5. Diverting the transfer strip sideways so as to introduce it into the rope scissors.
6. Swiveling the rod 13*c* back from position B'' to position A''.
7. Lowering the foil box 18*a* and the guide roll 21.
8. Moving the cutoff squirt to the full paper web width.

While there has been described above the principles of this invention in connection with specific apparatus, it is to be clearly understood that this description is made only by way of example and not as a limitation to the scope of the invention.

What is claimed is:

1. An apparatus for transferring a paper web from the press section to the drying section of a paper machine comprising:

a continuous machine-wide backing belt running over a guide roll arranged in the press section and at least a first drying cylinder contained in the drying section;

a rope carrier means, positioned in the drying section on one side of the paper machine and outside of the paper web width, for receiving and facilitating the threading of a transfer strip, said transfer strip being a narrow edge strip of the paper web;

an elongate guide element mounted so as to be moveable with respect to said guide roll, said guide element being moveable between one position in which said guide element is contained in the space between said guide roll and the adjacent press section roll so as to not contact the transfer strip, and another position in which the guide element is positioned along the portion of the guide roll circumference around which the transfer strip loops so as to engage the transfer strip.

2. The apparatus of claim 1 wherein said guide element can be moved between its one and other positions by being swiveled along the circumference of said guide roll.

3. The apparatus of claim 2 wherein the swivel axis about which said guide element is swiveled is eccentric to the axis of rotation of said guide roll so that the space between said guide roll and said guide element is smaller in its one position than in its other position.

4. The apparatus of claim 1 further including means for adjusting the position of said guide roll so that the space between said guide roll and the adjacent said press section roll is selectively variable.

5. An apparatus for transferring a paper web from a press section to the drying section of a paper machine comprising:

a continuous-wide backing belt running over a guide roll positioned in the press section and at least a first drying cylinder contained in the drying section, said guide roll receiving the paper web passing upwardly from a press roll in the press section wherein the press roll is positioned below the guide roll;

a rope carrier means, positioned in the drying section on one side of the paper machine and outside of the paper web width, for receiving and facilitating the threading of a transfer strip, said transfer strip being a narrow edge strip of the paper web;

an elongate guide element positioned so as to be generally parallel with the axis of rotation of said guide roll and moveable between two positions, in a first of said positions said guide element extends above the paper web in the space between said guide roll and said press roll, and in the second position said guide element extends into the space between said paper guide roll and the first drying cylinder so as to engage said paper web.

6. The apparatus of claim 5 wherein said guide element is swivelable along the circumference of said guide roll about a swivel axis which is eccentric relative to the axis of rotation of said guide roll so that the space between said guide element and the paper guide roll becomes greater as said guide element moves from the first position to its second position.

* * * * *